US010094127B2

(12) United States Patent
Kusakari et al.

(10) Patent No.: US 10,094,127 B2
(45) **Date of Patent: *Oct. 9, 2018**

(54) REINFORCING BAR BINDING MACHINE

(71) Applicant: MAX CO., LTD., Tokyo (JP)

(72) Inventors: Ichiro Kusakari, Chuo-ku (JP); Akira Kasahara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 210 days.

This patent is subject to a terminal disclaimer.

(21) Appl. No.: 14/734,486

(22) Filed: Jun. 9, 2015

(65) Prior Publication Data

US 2015/0267423 A1 Sep. 24, 2015

Related U.S. Application Data

(63) Continuation of application No. 14/278,467, filed on May 15, 2014, which is a continuation of application (Continued)

(30) Foreign Application Priority Data

Dec. 12, 2008 (JP) ..... 2008-316889
May 12, 2009 (JP) ..... 2009-115150

(51) Int. Cl.
*E04G 21/12* (2006.01)
*B65B 13/02* (2006.01)

(52) U.S. Cl.
CPC ..... *E04G 21/122* (2013.01); *B65B 13/025* (2013.01); *E04G 21/123* (2013.01)

(58) Field of Classification Search
CPC ..... B21F 15/02; B21F 15/04; B65B 13/025; B65B 13/04; B65B 13/08; B65B 13/14; (Continued)

(56) References Cited

U.S. PATENT DOCUMENTS 4,586,667 A 5/1986 Rodenbeck
4,685,493 A 8/1987 Yuguchi
(Continued)

FOREIGN PATENT DOCUMENTS

CN 201110005 9/2008
EP 0 714 830 A1 6/1996
(Continued)

OTHER PUBLICATIONS

Australian Office Action dated May 11, 2016 issued in corresponding Australian Patent Application No. 2015249026 (3 pages).
(Continued)

*Primary Examiner* — Debra Sullivan
(74) *Attorney, Agent, or Firm* — Drinker Biddle & Reath LLP

(57) ABSTRACT

A reinforcing bar binding machine is provided with a cutting die having a wire through hole which penetrates through the die along a direction in which a wire is fed out, a blade portion adapted to move along an open plane of an opening at one end of the wire through hole to cut a terminating end portion of the wire which has passed through the wire through hole and an engagement portion adapted to be brought into engagement with a portion of the wire which lies in the vicinity of the terminating end portion thereof when the blade portion is rotated so as to bend to hold the portion lying in the vicinity of the terminating end portion.

2 Claims, 15 Drawing Sheets

Related U.S. Application Data

No. 12/636,103, filed on Dec. 11, 2009, now Pat. No. 8,752,593.

(58) Field of Classification Search

CPC ..... B65B 13/027; B25B 25/00; E04G 21/122; E04G 21/123

See application file for complete search history.

(56) References Cited

U.S. PATENT DOCUMENTS

| | | | |
|---|---|---|---|
| 5,279,336 | A | 1/1994 | Kusakari et al. |
| 5,442,848 | A | 8/1995 | Koller et al. |
| 5,558,134 | A | 9/1996 | Miyazaki |
| 5,778,946 | A | 7/1998 | Pellenc et al. |
| 5,956,989 | A | 9/1999 | Kusakari et al. |
| 8,127,803 | B2 | 3/2012 | Kusakari |
| 2005/0284534 | A1 | 12/2005 | Chen |
| 2008/0006341 | A1 | 1/2008 | Kusakari et al. |
| 2008/0110354 | A1 | 5/2008 | Itagaki et al. |

FOREIGN PATENT DOCUMENTS

| | | | |
|---|---|---|---|
| EP | 0 751 269 | A1 | 1/1997 |
| EP | 0 757 143 | | 2/1997 |
| EP | 0 886 020 | A1 | 12/1998 |
| EP | 1 557 359 | A1 | 7/2005 |
| EP | 1 840 030 | A1 | 10/2007 |
| EP | 2 123 849 | A1 | 11/2009 |
| JP | 7-2201 | | 1/1995 |
| JP | 7-48931 | | 2/1995 |
| JP | A-H07-275983 | | 10/1995 |
| JP | 07-290177 | | 11/1995 |
| JP | 08-277632 | | 10/1996 |
| JP | 9-165006 | | 6/1997 |
| JP | A-09-165917 | | 6/1997 |
| JP | 11-169981 | | 6/1999 |
| JP | 3-010353 | | 2/2000 |
| JP | 2000-064617 | | 2/2000 |
| JP | 11006299 | | 11/2003 |
| JP | A-2006-200196 | | 8/2006 |
| WO | WO 2007/042785 | A2 | 4/2007 |
| WO | WO 2009/142215 | A1 | 11/2009 |

OTHER PUBLICATIONS

Australian Office Action dated Jun. 30, 2016 issued in corresponding Australian Patent Application No. 2016201246 (5 pages).

Korean Office Action, along with its English-language translation, dated Sep. 22, 2016 issued in corresponding Korean Patent Application No. 10-2016-0108835 (7 pages).

REINFORCING BAR BINDING MACHINE

This is a continuation application of U.S. application Ser. No. 14/278,467 filed on May 15, 2014, which is a continuation of U.S. application Ser. No. 12/636,103, filed on Dec. 11, 2009, now U.S. Pat. No. 8,752,593 issued on Jun. 17, 2014, each application being incorporated by reference herein.

BACKGROUND OF THE INVENTION

Field of the Invention

The present invention relates to a reinforcing bar binding machine for binding reinforcing bars by feeding out a wire that is pulled out of a wire reel from a guide portion provided at a distal end of a binding machine main body to a periphery of the reinforcing bars so as to turn thereround in a loop-like fashion and twisting the wire.

Background Art

As is shown in Patent Documents 1 and 2, a reinforcing bar binding machine has a beak-like guide portion that is provided at a distal end thereof. Two reinforcing bars that intersect each other are inserted into the guide portion, a wire is pulled out of a wire reel, and the wire to which a curling-tendency is applied is fed out while being curled, whereby the wire is wound round the reinforcing bars in a loop-like fashion. After the wire has been so wound round the reinforcing bars, a terminating portion of the wire is cut by a cutter, and part of the looped wire is turned while being gripped by a twisting hook, whereby the reinforcing bars are bound together by the wire being so twisted.

[Patent Document 1] U.S. Pat. No. 5,279,336

[Patent Document 2] JP-A-11-169981

Incidentally, when binding the reinforcing bars, the guide portion of the reinforcing bar binding machine is inserted from one side (a front side) to the other side (a rear side) of an intersecting portion of two reinforcing bars, and after the two reinforcing bars are bound together, the guide portion is pulled out. It is common that an initiating end portion and a terminating end portion of the wire that is wound round the reinforcing bars lie in a position which is away from a twisted portion, and both the end portions never fail to be free. Consequently, normally, as is shown in FIG. 7(*a*), two end portions 105*a*, 105*b* of a wire 105 lie on an opposite side to a side where a twisted portion 105*c* lies. However, when the wire is twisted, there occurs from time to time a case in which one or both of the end portion of the wire project laterally due to the effect of twisting the wire. Then, when the reinforcing bar binding machine is pulled back to disengage the guide portion from the reinforcing bar after the twisting of the wire is completed, there occurs from time to time a case in which as is shown in FIG. 7(*b*), either of both of the two end portions 105*a*, 105*b* of the wire 105 which are made free are caught by the guide portion or the like and are then caused to move to a twisted portion 105*c* side of the reinforcing bar together with the reinforcing bar binding machine. As this occurs, since the end portion or end portions of the wire project to the twisted portion side to thereby be away from the reinforcing bar, not only does the external appearance of the reinforcing bar get worse, but also when concrete is placed in this state, there occurs from time to time a case in which the end portion or end portions of the wire project from a surface of the concrete so placed. When the wire is exposed from the concrete surface, rainwater infiltrates into an interior of the concrete through a gap between the wire and the concrete, causing cracks therein.

To deal with this, a mechanism is considered in which the wire is deformed to be held by the cutter and a distal end portion of the guide portion. According to this configuration, since the terminating end portion of the wire is held by the guide portion, when the guide portion is pulled out after the reinforcing bar are bound together, the initiating end portion of the wire is held down by the terminating end portion of the wire, whereby both the end portions can be kept staying on the rear side of the reinforcing bar.

However, when the amount of wire remaining in the wire reel reaches almost zero and an interval between the terminating end portion of the wire used last and an end portion of the wire remaining on the wire reel side is short, there occurs from time to time a case in which the remaining wire piece jams while being caught by the cutter and the distal end portion of the guide portion.

Since when the wire jams, the wire reel cannot be replaced by a new wire reel so as to feed out a wire, the guide portion has to be disassembled to remove the wire piece.

Further, in the conventional reinforcing bar binding machine, as is shown in Patent Documents 3, 4, curl guides are disposed vertically for applying a curling-tendency on a wire to curl the wire. A movable curl guide is provided so as to be opened and closed, and by the movable curl guide being designed to be opened and closed, a construction is enabled in which reinforcing bar which are bound together are easily removed from a binding machine main body. In addition, the opening and closing construction has a function as a safety device. When the movable curl guide is opened, it is judged that the finger or fingers of the operator or a tool is placed between the curl guides for maintenance or an abnormal state is occurring in which something jams, and the binding machine is designed not to operate. Since an opening or closing signal of the movable curl guide is sent to the binding machine main body, an opening becomes necessary which links an interior with an exterior of the binding machine main body. In addition, since a sensor for detecting the movable curl guide is disposed in the interior of the binding machine main body so as not to be influenced by dust, impact and disturbance, a signal is transmitted from the exterior to the interior of the binding machine main body by a mechanical means. Because of this, a relatively large opening is formed in a signal transmission portion of the binding machine main body.

[Patent Document 3] U.S. Pat. No. 5,956,989

[Patent Document 4] JP-A-09-165006

In the conventional reinforcing bar binding machine described above, when the movable curl guide is closed, the opening is also closed by a curl guide cover, and therefore, a foreign matter such as a small piece of wire is made difficult to enter the binding machine main body. However, when initializing is implemented, a wire is twisted to be cut or a wire reel becomes empty, there occurs from time to time a case in which a small piece of wire falls in the movable curl guide. Since when the curl guide is opened, an opening is produced between the movable curl guide and the curl guide cover, the cut small piece of wire sometimes enters the interior of the binding machine main body. In addition, since a total closure is not always provided between the movable curl guide and the curl guide cover but a small gap is formed therebetween, when the binding machine is used while being oriented upwards or when a jamming wire is attempted to be removed, there occurs from time to time a case in which the cut small piece of wire slides down on the movable curl guide to enter the interior of the binding machine main body from the gap.

In the event that the wire piece enters the binding machine main body, there is a possibility that a problem is caused that the wire piece gets stuck in a movable part, the wire piece enters the interior of a motor to lock the motor, or the detection by a magnetic sensor is delayed, leading to an operation failure of the reinforcing bar binding machine.

SUMMARY OF THE INVENTION

One or more embodiments of the invention provide a reinforcing bar binding machine in which both ends of a wire are kept staying on a rear side of reinforcing bar at all times in an ensured fashion and the jamming of a wire piece can be prevented well.

According to one or more embodiments of the invention, a reinforcing bar binding machine is provided with a cutting die 114 having a wire through hole 117 which penetrates through the die along a direction in which a wire 105 is fed out, a blade portion 115*a* adapted to move along an open plane 118 of an opening 117*a* at one end of the wire through hole 117 to cut a terminating end portion 105*b* of the wire 105 which has passed through the wire through hole 117 and an engagement portion 130 formed on the blade portion 115*a* and adapted to be brought into engagement with a portion of the wire 105 which lies in the vicinity of the terminating end portion 105*b* thereof when the blade portion 115*a* is rotated so as to bend to hold the portion lying in the vicinity of the terminating end portion. The blade portion 115*a* may be provided on a cutter main body 115 which is provided so as to rotate round the periphery of the cutting die 114.

According to the construction described above, since the engagement portion is brought into engagement with the portion of the wire which lies in the vicinity of the terminating end portion thereof so as to bend to hold the portion lying in the vicinity of the terminating end portion, the end portion of the wire cut is kept held until the twisting operation is completed to complete the binding of the reinforcing bar. Consequently, since an initiating end portion of the wire is held down by the terminating end portion of the wire until the guide portion is pulled out of the reinforcing bar after the reinforcing bar have been bound together, both the end portions can be kept staying on the rear side of the reinforcing bar. In addition, even in the event that the amount of the wire remaining within the wire reel reaches almost zero, eventually leaving a short piece of wire, since the piece of wire is only in engagement with the engagement portion of the blade portion of the cutter main body, the wire piece is easily disengaged from the engagement portion. Consequently, the jamming of the wire piece can be prevented well.

Since the terminating end portion of the wire can be held only by the cutter main body, there is imposed no limitation on shapes of other members.

The engagement portion 130 may have a first engagement plane 131 adapted to be brought into contact with the wire 105 when the wire is cut and made up of a plane which intersects the open plane 118 when the wire is cut and a second engagement plane 132 which intersects the first engagement plane 131 at an acute angle at a portion of the first engagement plane 131 which lies on an opposite side to a side facing the opening 117*a* of the wire through hole.

According to the construction described above, since the engagement portion is formed by making acute an edge of the blade portion of the cutter main body, no special member is required. Consequently, costs involved in improvement can be suppressed to a lower level.

According to one or more embodiments of the invention, there is provided a reinforcing bar binding machine comprising a mechanism for preventing a foreign matter such as a small piece of wire which happens to fall on a movable curl guide from entering an interior of a binding machine main body in an ensured fashion.

According to one or more embodiments of the invention, a reinforcement binding machine is provided with a fixed curl guide 5 for applying a curling-tendency on a wire and feeding out the wire downwards, a movable curl guide 10 which is mounted in an opening 14 formed at a lower portion in a binding machine main body 2 at a base portion thereof via a pivot 15 so as to rotate about the pivot 15 relative to the binding machine main body 2 and adapted to receive the wire sent from the fixed curl guide 5 side to guide again the wire so received towards the fixed curl guide 5 lying thereabove, and a cover portion 27 provided between the movable curl guide 10 and an upper surface portion 16 of the opening 14, so as to close a gap between the base portion of the movable curl guide 10 and the upper surface portion 16 of the opening 14 at all times.

According to the construction described above, the base portion of the movable curl guide is provided in the opening formed at the lower portion of the binding machine main body via the pivot so as to rotate downwards and the cover portion is formed for covering the gap between the base portion of the movable curl guide and the upper surface portion of the opening at all times, whereby a foreign matter such as a small piece of wire which happens to fall on the movable curl guide from entering an interior of the binding machine main body in an ensured fashion, irrespective of the rotation of the movable curl guide.

A sectional shape of the cover portion 27 which is normal to the pivot 15 may be formed into an arc-like shape which is centered at the pivot 15.

According to the construction described above, since the cover portion is formed into the arc-like shape in section which is centered at the pivot, when the movable curl guide rotates, the cover can close the gap between the base portion of the movable curl guide and the upper surface portion of the opening continuously at all times.

The cover portion 27 may be formed into a bellows-like shape.

According to the construction described above, since the cover portion is formed into the bellows-like shape, even though the gap between the base portion of the movable curl guide and the upper surface portion of the opening is increased or decreased as the movable curl guide rotates, the cover portion can cover the gap at all times accordingly.

The cover portion may be formed integral with or separate from the movable curl guide.

According to the construction described above, since the cover portion is formed integral with or separate from the movable curl guide, in the event that the cover portion cannot be formed integrally due to a problem with molding or difference in material, the cover portion may be formed as a separate element from the movable curl guide, whereas in the event that the cover portion can be formed integral with the movable curl guide, they may be formed integral with each other. Alternatively, separate elements may be joined integrally by welding or the like.

BRIEF DESCRIPTION OF THE DRAWINGS

FIG. 9(*b*) is a sectional view showing an operating state of the movable curl guide.

DETAILED DESCRIPTION OF THE EXEMPLARY EMBODIMENTS

First Exemplary Embodiment

Figure 1:
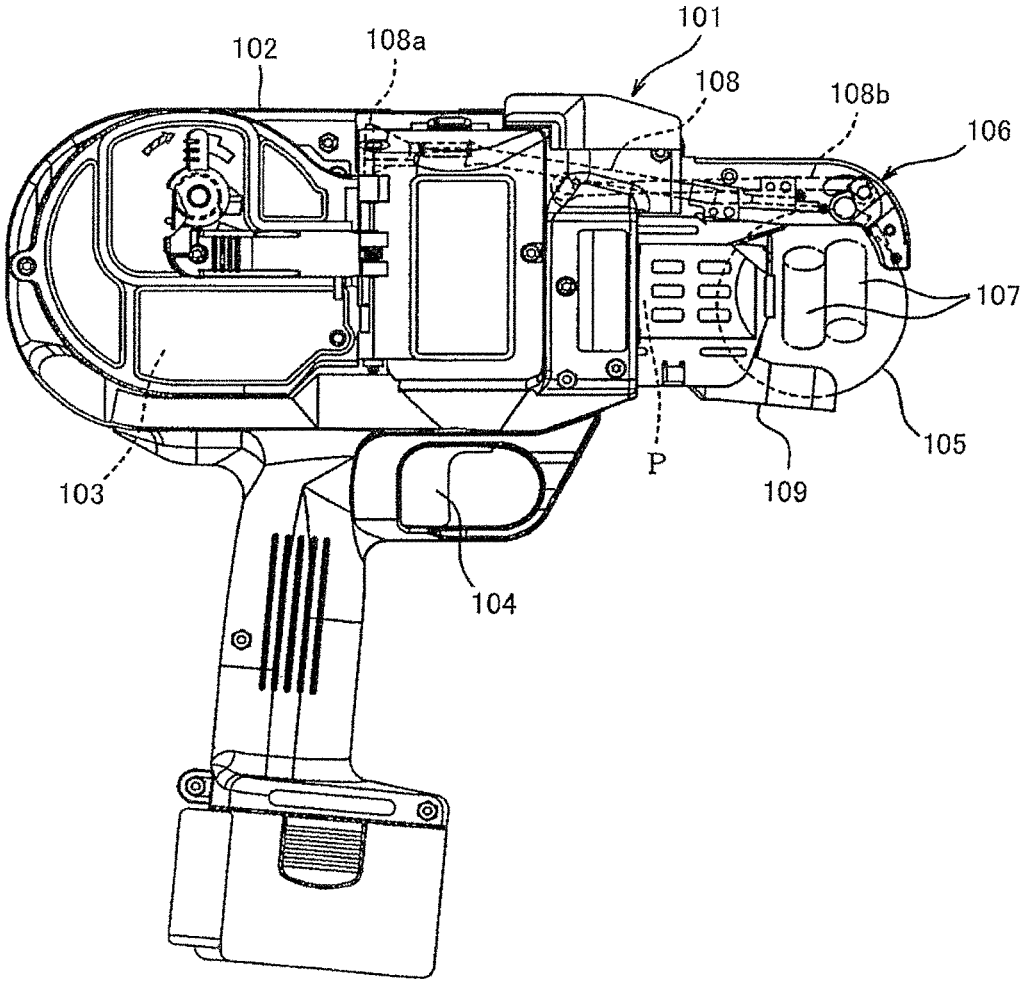
FIG. 1 is a side view of a reinforcing bar binding machine according to a first exemplary embodiment of the invention.
Figure 2:
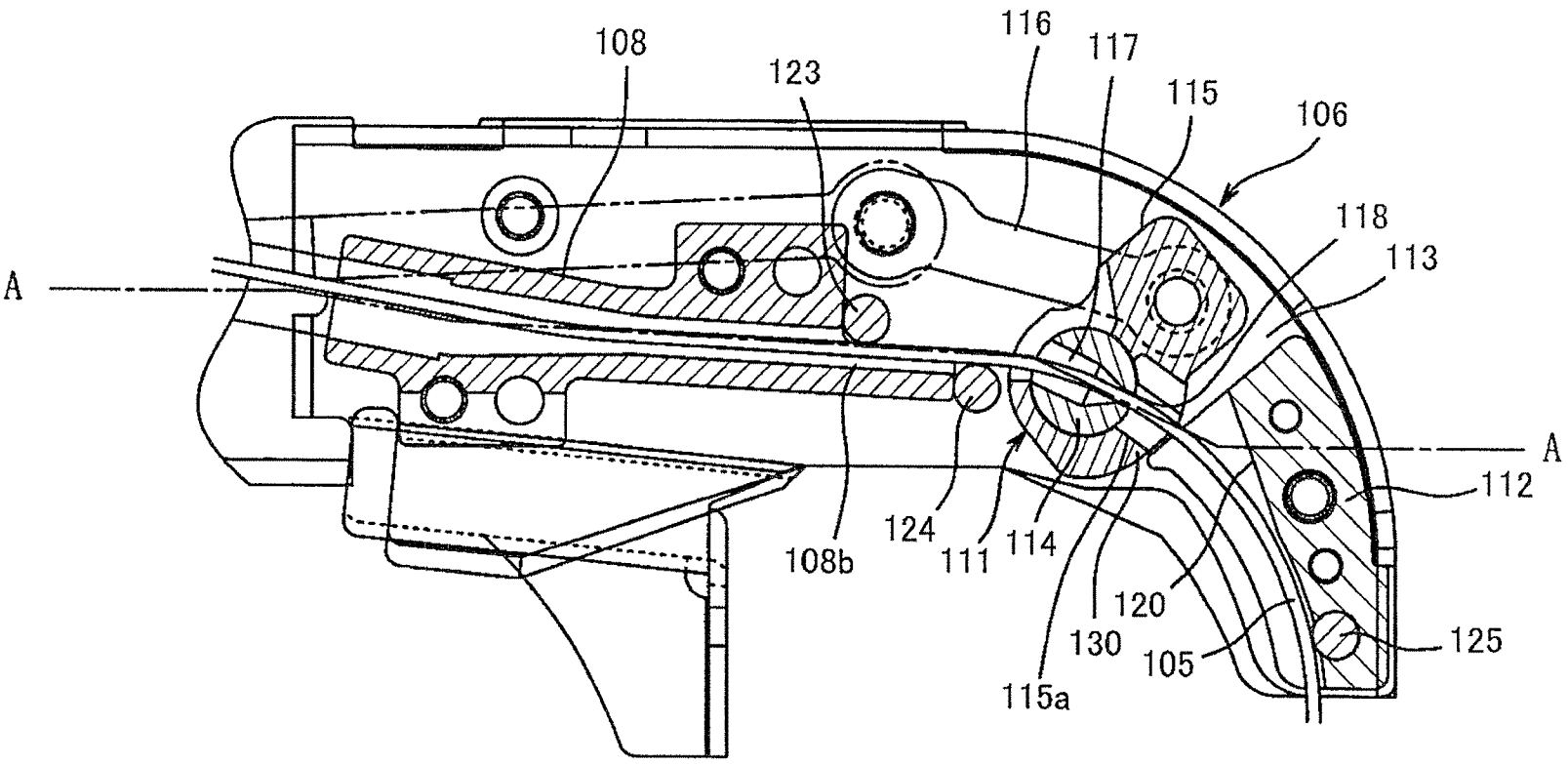
FIG. 2 is an interior block diagram of a guide portion of the reinforcing bar binding machine.
Figure 3:
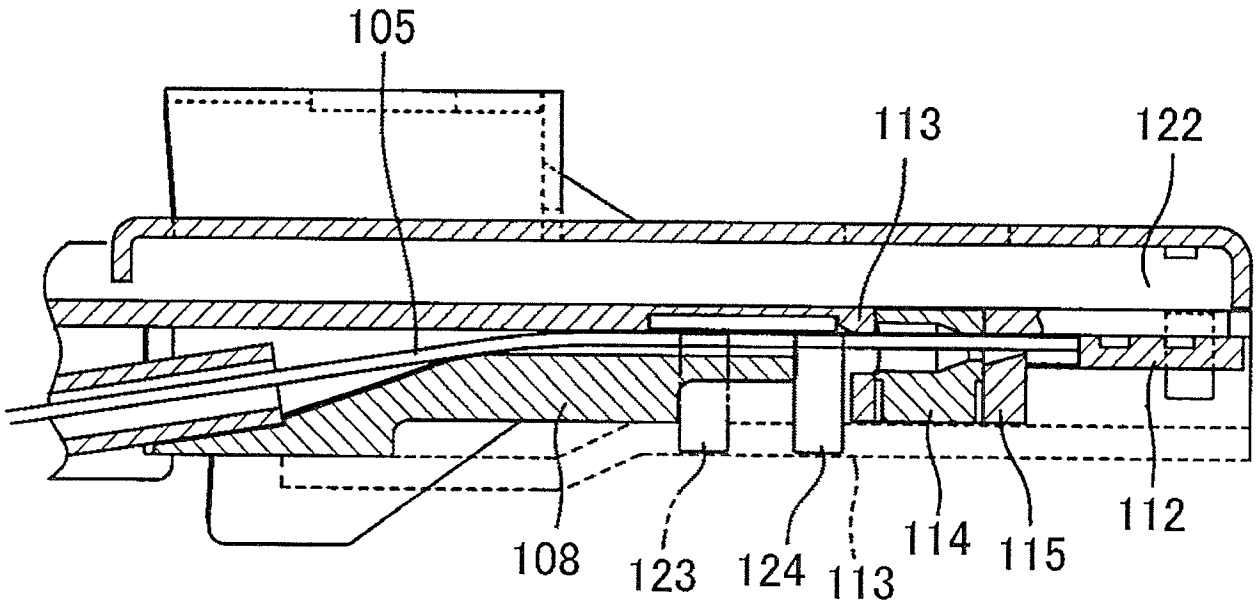
FIG. 3 is a sectional view taken along the line A-A in FIG. 2.

In FIGS. 1 to 3, reference numeral 101 denotes a reinforcing bar binding machine. A wire reel round which a reinforcing bar binding wire 105 is wound is installed in an accommodation chamber 103 provided in a binding machine main body 102 of the reinforcing bar binding machine 101. By a trigger 104 being pulled, the wire reel starts to rotate, so as to feed out the wire 105 to a guide portion 106 which is provided at a distal end of the binding machine main body 102. While being applied a curling-tendency in the guide portion 106, the wire 105 is fed out to move round reinforcing bars 107 which are disposed inside the guide portion 106. After the wire 105 is caused to turn round the periphery of the reinforcing bars 107, the wire 105 is cut at a proximal side, and the portion of the wire which is wound round the reinforcing bar is twisted, whereby the reinforcing bars 107 are bound together.

A guide tube 108 through which the wire 105 pulled out of the wire reel is passed is provided in the binding machine main body 102. One end 108*a* of the guide tube 108 is made to open to the accommodating chamber 103. The other end 108*b* of the guide tube 108 is situated before the guide portion 106. A feeding device for feeding the wire 105 is provided at an intermediate portion along the length of the guide tube 108. In the feeding device, the wire 105 is fed forwards by an electric motor (not shown).

The guide portion 106 is formed in front of the guide tube 108, and in the guide portion 106, the wire 105 which is fed into the binding machine main body 102 is applied the curling-tendency so that the wire 105 is fed thereout while being curled. A distal end of the guide portion 106 is curved into an arc-like shape. The wire 105 is applied the curling-tendency at the distal end of the guide portion 106, so as to turn circumferentially round the reinforcing bars 107 between the distal end of the guide portion 105 and a lower guide 109.

A curling-tendency applying mechanism is provided in the guide portion 106 for applying the curling-tendency on the wire 105 which reaches it after having passed through an interior of the guide tube 108 while being guided in a straight line into a curve so that the wire 105 is fed thereout while being curled.

Namely, a J-shaped guide frame 113 is provided in the guide portion 106. In the guide frame 113, the end portion of the guide tube 108 which guides the feeding out of the wire 105 from the wire reel, a wire cutting mechanism for cutting the wire after a predetermined mount of the wire 105 is fed out, and a fixed curl guide 112 for forming the wire 105 fed thereto by way of the wire cutting mechanism 111 into a curve are disposed sequentially in that order.

The end portion 108*b* of the guide tube 108 is disposed at a base portion of a curved portion which lies near a distal end of the guide frame 113. The end portion 108*b* of the guide tube 108 is constricted so that the wire 105 is guided to exit from a determined position. The wire 105 so guided to exit the guide tube 108 is cut by the cutting mechanism 111 after having been fed out in a predetermined amount so as to be wound round the reinforcing bars 107.

The feeding-out amount of the wire 105 reaches a predetermined amount, the wire cutting mechanism 111 cuts the wire 105. The wire cutting mechanism 111 is made up of the cutting die 114, having a shaft-like shape, which is fixed to the guide frame 113, a cutter main body 115 which is provided so as to rotate round the periphery of the cutting die 114 and a drive lever 116 which rotates the cutter main body 115.

A wire through hole 117 is formed in the cutting die 114 so as to penetrate therethrough along a direction in which the wire 105 is fed out. One end of the wire through hole 117 is made to open to the end portion 108*b* of the guide tube 108. The other end of the wire through hole 117 is made open to the fixed curl guide 112. The wire through hole 117 is formed so as to have a diameter which is so large that the wire 105 sent from the guide tube 108 is not brought into contact with the wire through hole 117 when the wire 105 penetrates into and passes through the through hole 117.

When the cutter main body 115 rotates, a blade portion 115*a* moves along an open plane 118 situated at the end portion of the wire through hole 117 which faces the fixed curl guide 112. When the cutter main body 115 is rotated by the drive lever 116 after the wire 105 is caused to penetrate into the wire through hole 117 so that the blade portion 115*a* thereof is caused to move along the open plane 118*a* at the end portion of the wire through hole 117 which faces the fixed curl guide 112, the wire 105 is cut.

The fixed curl guide 112 is fixed in place on a distal end side of the guide frame 113. As is shown in FIG. 2, the fixed curl guide 112 forms a guide groove 120 for guiding the wire 105 in a direction in which the wire 105 is curled in cooperation with the guide frame 113 on both sides thereof.

A curl catching guide 122 (refer to FIG. 3) is formed adjacent to the fixed curl guide 112 in the guide portion 116, and this curl catching guide 122 catches an initiating end portion of the wire 105 which is fed out of the fixed curl guide 112 to return after having turned circumferentially round the reinforcing bar in a loop-like fashion and guiding the initiating end portion so caught for another circumferential turn round the reinforcing bar.

In the configuration described above, the wire 105 fed out of the guide tube 108 passes through the wire through hole 117 in the cutting die 114 and is fed out further along the guide groove 120 of the fixed curl guide 112. Since the wire 105 contacts a guide surface under a constant pressure in association with a feeding speed of the wire 105, the wire 105 is bent into a curved shape so as to be applied the curling-tendency.

Incidentally, a first guide pin 123 and a second guide pin 124 are provided at the end portion (or in the vicinity of the end portion) of the guide tube 108. The first guide pin 123 and the second guide pin 124 project inwards of the guide tube 108. A dimension between a lower end of the first guide pin 123 and an upper end of the second guide pin 124 is set to be almost the same as the diameter of the wire 105. By this, the wire 105 is fed out with an external surface of the wire which constitutes an outer side of the bent wire 105 guided by the first guide pin 123 and an internal surface of the wire which constitutes an inner side of the bent wire 105 guided by the second guide pin 124.

A third guide pin 125 is provided on an inner side of a distal end of the fixed curl guide 112. The third guide pin 125 is attached so as to project slightly further inwards than the guide surface of the fixed curl guide 112. Consequently, the external surface of the bent wire 105 which is fed out along the guide groove 120 of the fixed curl guide 112 is brought into contact with the third guide pin 125 to thereby be fed out downwards in FIG. 1. The first to third guide pins 123 to 125 are preferably formed of a highly hard material such as an ultra high hardness pin or a ceramic pin.

As has been described heretofore, the wire fed out of the guide tube 108 is brought into contact with the first guide pin 123 and the second guide pin 124 which are disposed on the distal end side of the guide tube 108. After having passed through the cutting die 114, the wire 105 is fed out along an inner surface of the fixed curl guide 112 and is then brought into abutment with the third guide pin 125 to thereby be forcefully applied the curling-tendency. In this way, the wire 105 is brought into contact with the first to third high hardness guide pins 123 to 125 but is never brought into direct contact with the distal end of the guide tube 108, the cutting die 114 and the guide groove 120.

The wire 105 is applied the curling-tendency in the guide portion 106 and is fed out to curl round the reinforcing bars 107 so as to turn round the periphery thereof. Thereafter, the proximal side of the wire 105 is cut by the cutting mechanism 111, and the portion of the wire 105 which is wound round the reinforcing bars 107 is twisted by a twisting unit so as to bind the reinforcing bars 107 together.

Figure 6A:
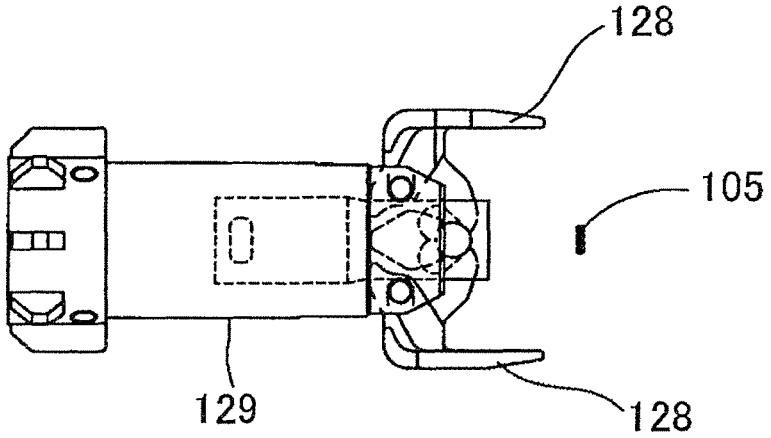
FIGS. 6(*a*), 6(*b*), 6(*c*) are operation explanatory diagrams resulting when a main part of a twisting mechanism is looked down from thereabove.
Figure 6B:
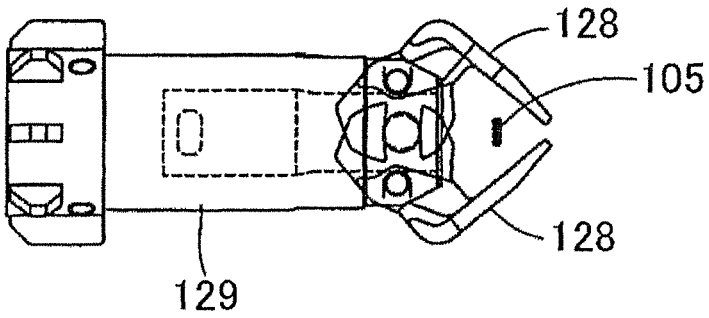
Figure 6C:
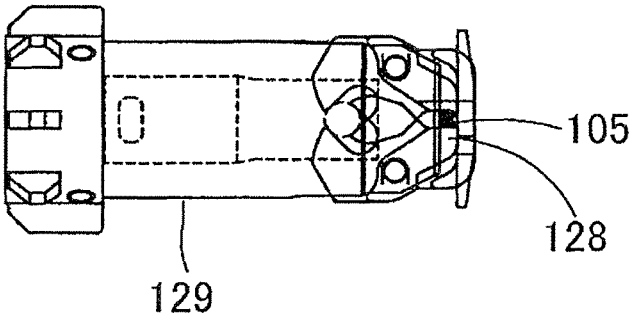
Figure 7B:
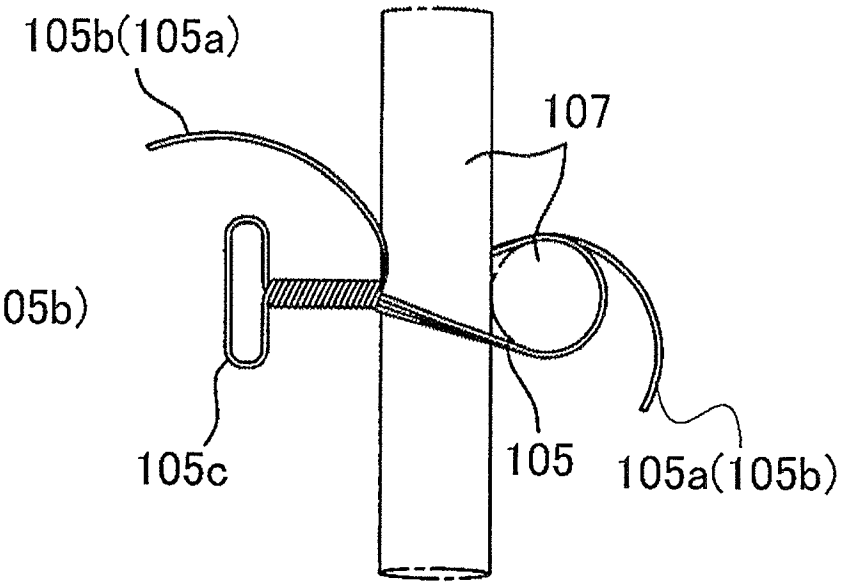
FIGS. 7(*a*) and 7(*b*) are perspective views showing states in which reinforcing bar are bound.
Figure 7A:
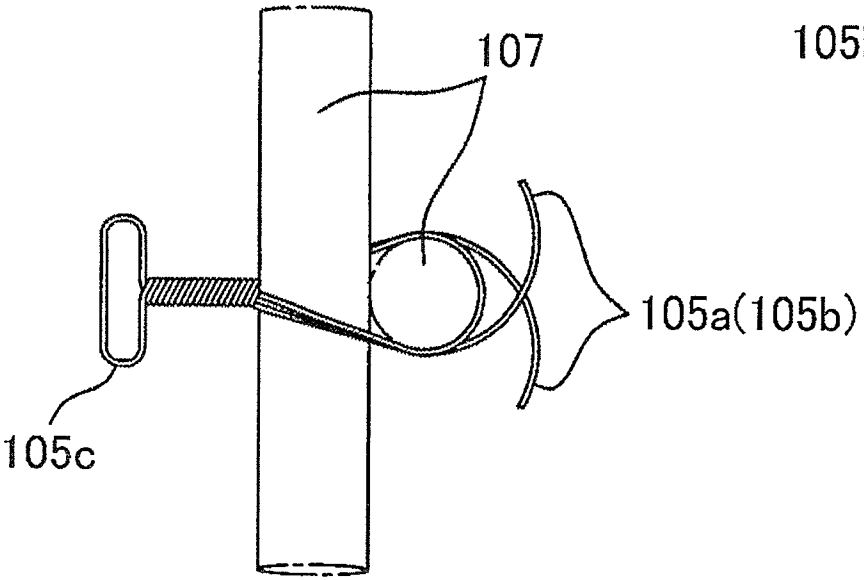

FIGS. 6(*a*) and 6(*b*) show a wire twisting unit. A sleeve 129, which is provided at a portion P in FIG. 1 and to which a pair of hooks 128 is pivotally attached so as to be opened and closed freely, is caused to advance forwards so that the hooks 128 are closed, whereby as is shown in FIG. 6(*c*), the wire 105 which is wound round the periphery of the reinforcing bar in the loop-like fashion is gripped. After the hooks 128 grip on the wire 105, the hooks 128 are rotated together with the sleeve 129, whereby the wire 105 is twisted to bind the reinforcing bar together. Thereafter, the hooks 128 are rotated in a reverse direction and the sleeve 129 is withdrawn so as to be detached from the wire 105 for return to its initial position. When the sleeve grips on the wire loop and advances forwards, the drive lever 116 of the cutting mechanism 111 is activated, so as to cut (shear) the wire 105.

Figure 4A:
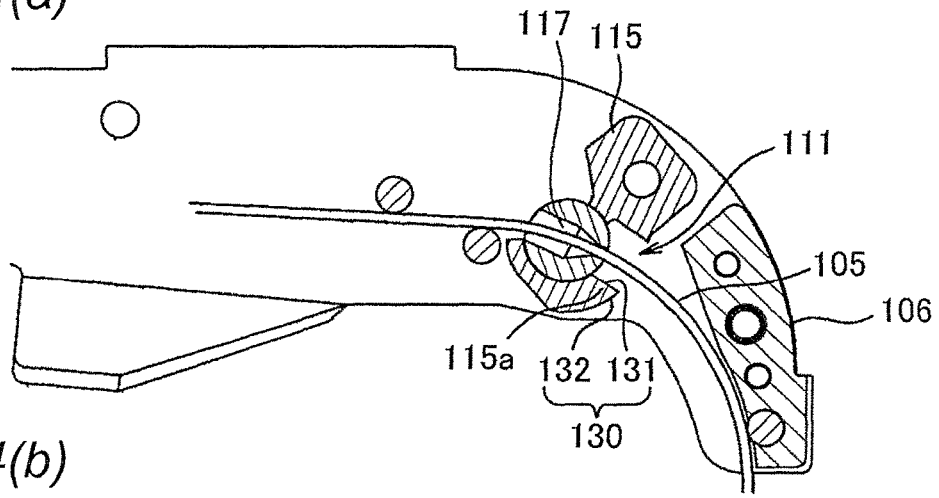
FIGS. 4(*a*), 4(*b*), and 4(*c*) are explanatory diagrams explaining an operating form of a curling-tendency applying mechanism.
Figure 4B:
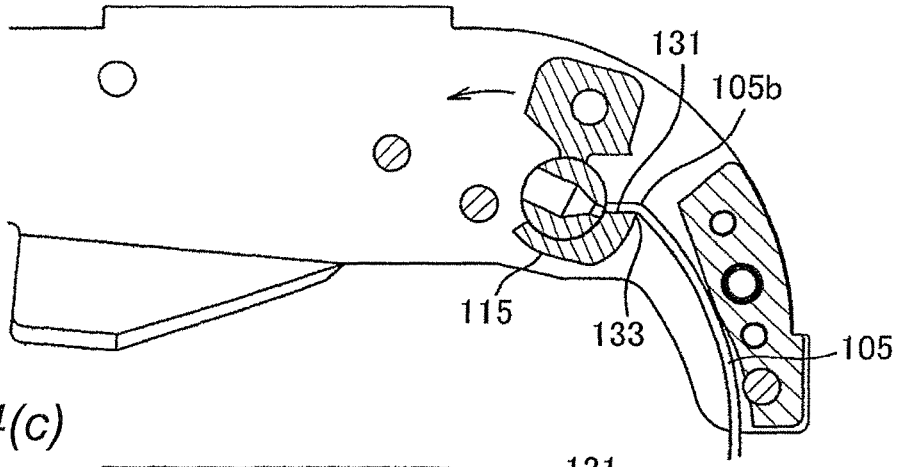
Figure 4C:
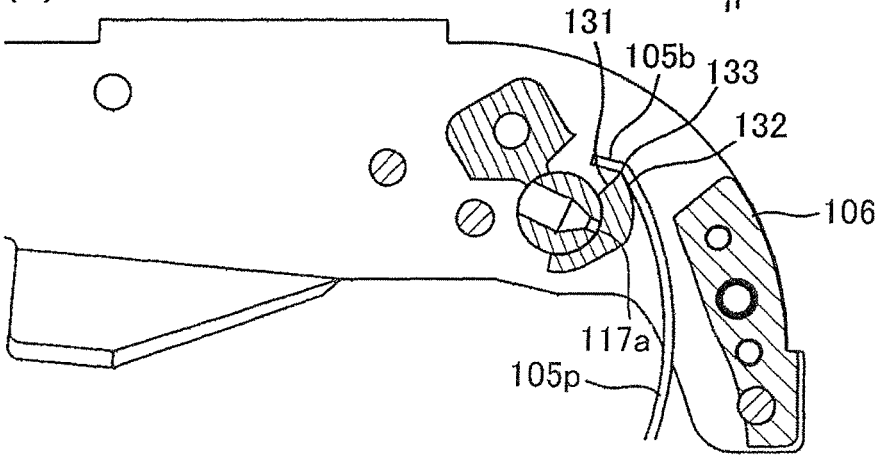

Incidentally, as is shown in FIG. 4(*a*), an engagement portion 130 is formed on the blade portion 115*a* of the cutter main body 115 for holding the terminating end portion of the wire. This engagement portion 130 forms a wire end portion holding mechanism. The engagement portion 130 is made up of a first engagement plane 131 which can be brought into engagement with a lower surface of the wire 105 which has penetrated through the wire through hole 117 when the wire is cut and a second engagement plane 132 which is formed to extend acutely from a distal end portion of the first engagement portion and which can be brought into engagement with the lower surface of the wire 105 after the wire 105 has been cut. The first engagement plane 131 is made up of a plane which intersects the open plane 118 of the wire through hole 117 when the wire is cut. (In this embodiment, the plane making up the first engagement plane 131 and the open plane 118 of the wire through hole 117 intersect each other at an angle of substantially 90 degrees. However, the wire can be cut even in the event that the intersecting angle when the wire is cut is not necessarily 90 degrees.) The second engagement plane 132 intersects the first engagement plane at a portion which lies on an opposite side of the first engagement plane 131 to a side which faces an opening 17*a* of the wire through hole. The first engagement plane 131 and the second engagement plane 132 intersect each other at an acute angle.

Figure 5:
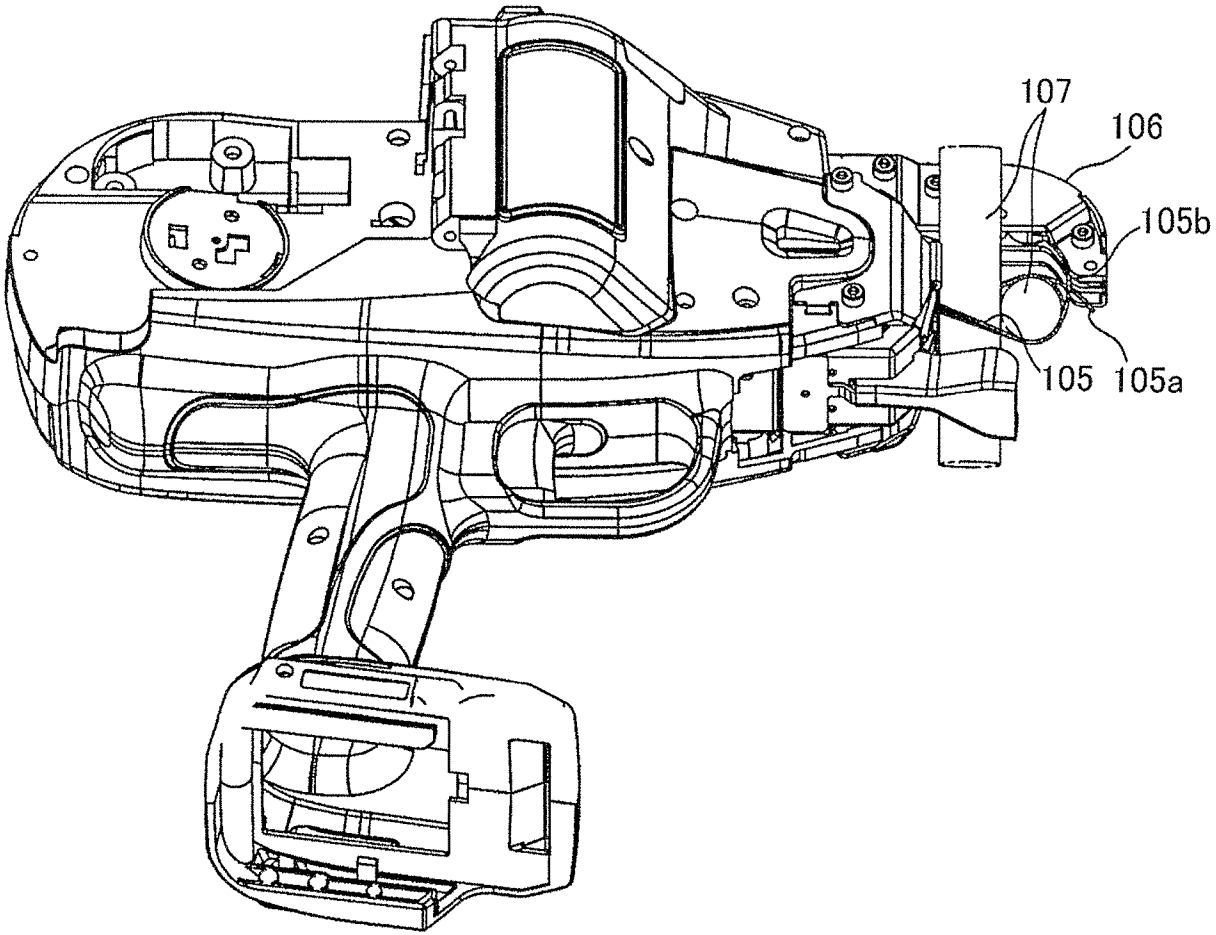
FIG. 5 is a perspective view resulting when the reinforcing bar binding machine is looked up obliquely from therebelow.

According to the configuration described above, since the engagement portion 130 is formed on the blade portion 115*a* of the cutter main body 115, when the cutter main body 115 rotates as a result of the wire cutting mechanism 111 being actuated after the wire 105 is applied the curling-tendency in the guide portion 106 and is then turned circumferentially round the reinforcing bars 107, the first engagement plane 131 of the engagement portion 130 is brought into engagement with the wire 105 being cut at the portion lying in the vicinity of the terminating end portion thereof so as to push up the wire 105 as is shown in FIG. 4(*b*) in the course of rotation of the cutter main body 115. By this, since although part of the wire 105 is brought into abutment with a groove bottom of the guide groove 120, the wire 105 cannot be pushed up any further than the groove bottom, the portion of the wire 105 which lies in the vicinity of the terminating end portion of the wire 105 is bent by a distal end portion 133 of the first engagement plane 131. As is shown in FIG. 4(*c*), the terminating end portion 105*b* of the wire 105 is kept caught on the distal end portion 133 of the first engagement plane 131 even after the cutter main body 115 completes its rotation and is held in such a state that the portion lying in the vicinity of the terminating end portion is in engagement with the second engagement plane 132. Consequently, as is shown in FIG. 5, the initiating end portion 105*a* of the wire 105 is caught on the portion of the wire 105 including the terminating end portion 105*b* of the wire 105 which is held by the guide portion 106 so as to be held down thereby. As a result, both the end portions 105*a*, 105*b* of the wire 105 are not allowed to move freely and can be kept staying on a rear side of the reinforcing bar. Even in the event that the amount of the wire 105 which remains within the wire reel reaches almost zero and a short piece of wire 105*p* as is shown in FIG. 4(*c*) is left at last, since this wire piece 105*p* is only in engagement with the engagement portion 130, the wire piece 105*p* is easily disengaged. Consequently, the jamming of the wire piece 105*p* in the guide portion 106 can be prevented well.

Moreover, since the terminating end portion of the wire 105 can be held only by the cutter main body 115, there is imposed no limitation on shapes of other members.

Second Exemplary Embodiment

Figure 8:
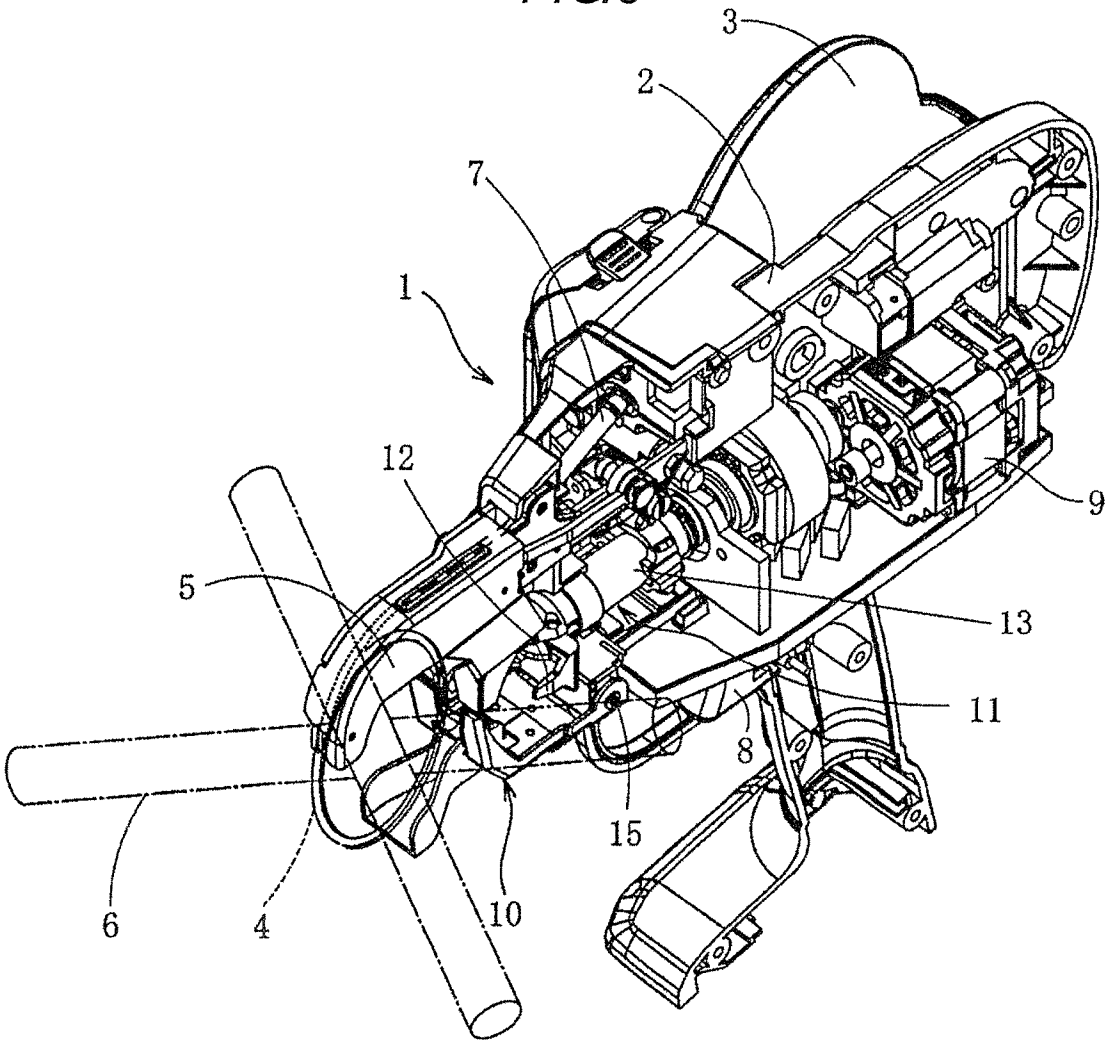
FIG. 8 is a perspective view showing a reinforcing bar binding machine according to a second exemplary embodiment of the invention together with interior mechanisms.

In FIG. 8, reference numeral 1 denotes a reinforcing bar binding machine. A wire reel (not shown) round which a wire 4 is wound is installed in an accommodation chamber 3 provided in a binding machine main body 2 of the reinforcing bar binding machine 1. The wire 4 is sent to a fixed curl guide 5 provided at a distal end of the binding machine main body 2 while rotating the wire reel, the wire 4 is applied a curling-tendency by the fixed curl guide 5 so as to curl round reinforcing bars 6 so as to turn round the periphery thereof, a proximal side of the wire 4 is cut, and the portion of the wire so turned round is twisted, whereby the reinforcing bars 6 are bound together.

A guide tube 7 through which the wire 4 pulled out of the wire reel is passed is provided in the binding machine main body 2. An end of the guide tube 7 is made to open to the accommodation chamber 3, and the other end is made to open to a base portion of the fixed curl guide 5. A pair of feeding gears (not shown) is installed in the guide tube 7 at an intermediate portion along the length thereof as a feeding device of the wire 4. The wire 4 is held between the gears and is designed to be fed out by the rotation of the gears.

When a switch is ON by a trigger 8, an electric motor rotates, which rotates the wire feeding gears. Then, the wire 4 wound round the wire reel accommodated in the accommodation chamber is fed out to the front of the binding machine main body 2 through the guide tube 7.

The fixed curl guide 5 and a movable curl guide 10 are disposed at a front end of the binding machine main body so as to project therefrom, and the fixed curl guide 5 applies the curling-tendency on the wire 4 sent from the wire reel to feed it out downwards, while the movable curl guide 10 guides the wire 4 sent thereto by the fixed curl guide 5 to return again to a predetermined position on the fixed curl guide 5 lying thereabove. A distal end of the fixed curl guide 5 is curved into an arc-like shape, and the wire 4 is applied the curling-tendency thereat so as to turn circumferentially round the reinforcing bars 6 in a loop-like fashion between the movable curl guide 10 and the fixed curl guide 5.

A wire cutting device (not shown) is installed in the fixed curl guide 5. The wire cutting device cuts the wire when a feeding-out amount of the wire 4 reaches a predetermined amount.

A wire twisting unit 11 is installed in an interior of the binding machine main body 2, and a twisting hook 12 is provided at a distal end portion of the wire twisting unit 11.

In the wire twisting unit 11, the hook 12 is pivotally attached to a sleeve 13 so as to be opened and closed freely, and the sleeve 13 is caused to advance forwards by an electric motor 9 so that the hook 12 is closed, whereby the wire 4 which is turned round the periphery of the reinforcing bars 6 in the loop-like fashion is gripped by the hook 12. The hook 12 is rotated together with the sleeve 13 so as to twist the wire 4, whereby the reinforcing bars 6 are bound together. Thereafter, the hook 12 is rotated in a reverse direction, and the sleeve 13 is withdrawn so as to be detached from the wire 4 for return to its initial position. The wire 4 is twisted as the sleeve 13 advances forwards after the wire has been cut.

The rotation of the feeding gears, cutting of the wire 4, operation of the wire twisting unit 11 and the like are sequence controlled by a control circuit, not shown. The control circuit also measures a feeding mount of the wire 4 based on a rotating amount of the feeding gears.

Figure 9A:
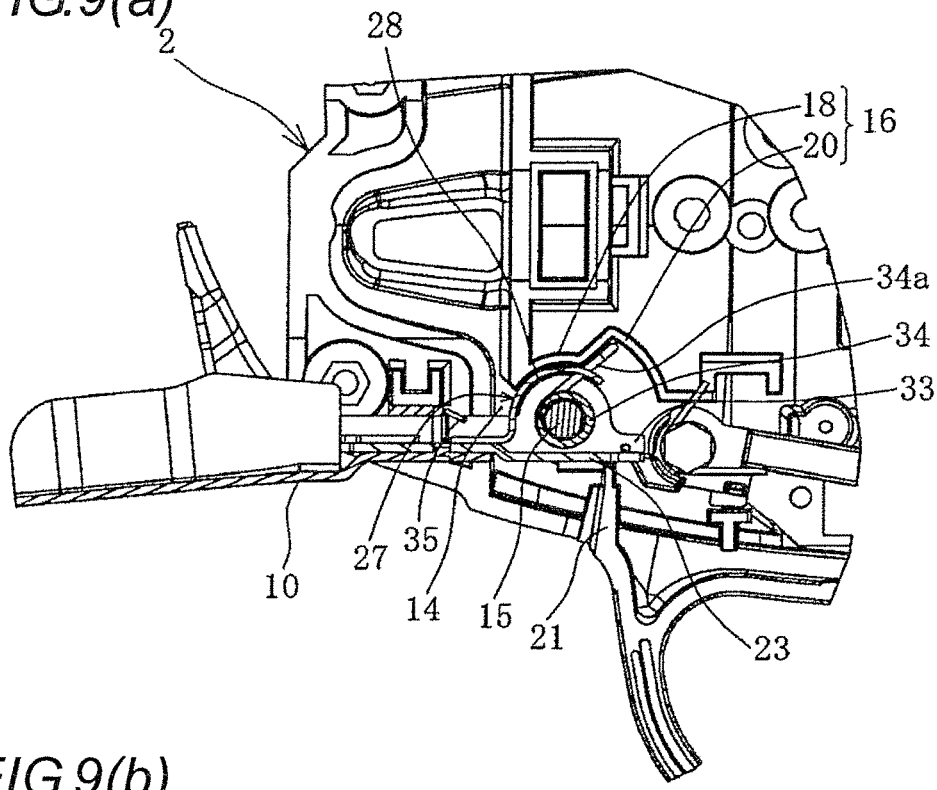
FIG. 9(*a*) is a sectional view of a movable curl guide in a waiting state.
Figure 9B:
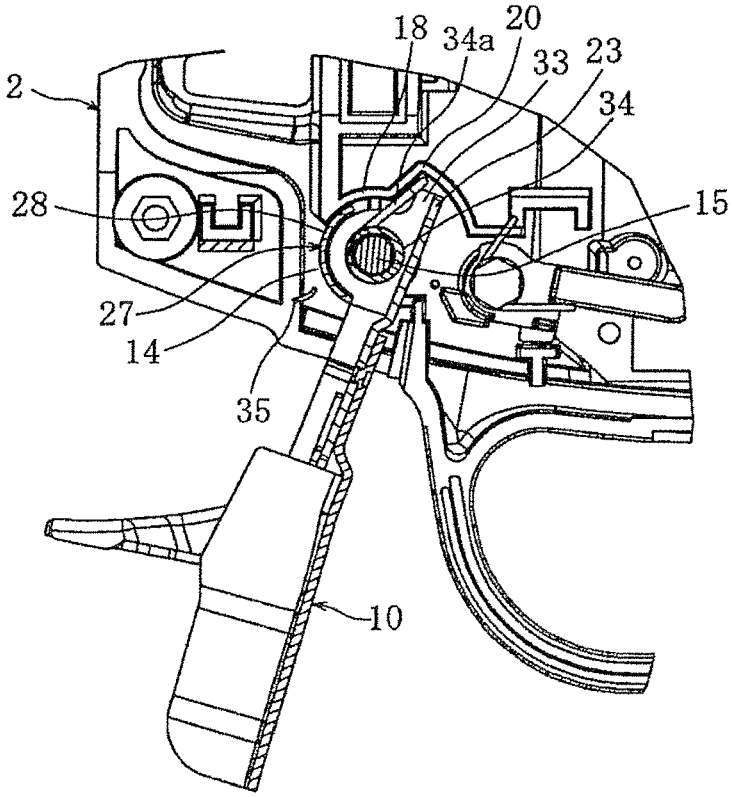
Figure 10:
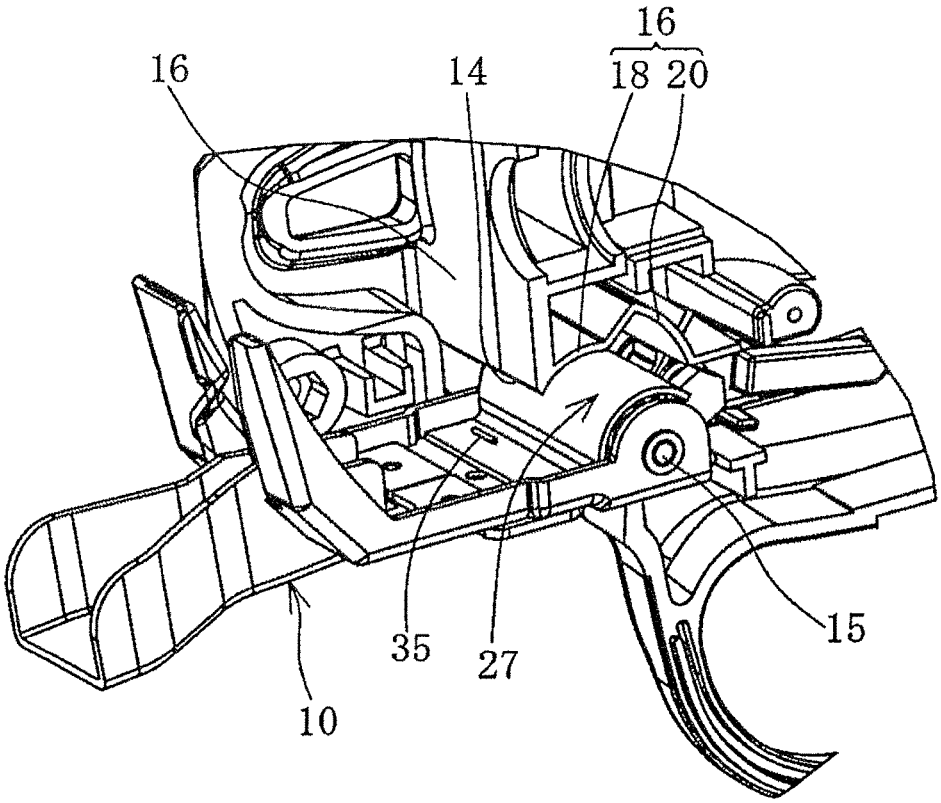
FIG. 10 is a perspective view of a peripheral portion of the movable curl guide.

Incidentally, as is shown in detail in FIGS. 9(*a*), 9(*b*) and 10, the movable curl guide 10 is provided in an opening 14 formed at a lower portion of the binding machine main body via a pivot so as to rotate downwards so that work such as maintenance work can easily be performed.

The opening 14 is formed to open at a central portion of a front wall 17 which makes up the lower portion of the binding machine main body, and an upper surface portion 16 is made up of a concave surface portion 18 which is formed into an arc-like shape in section and a triangular groove-like recess portion 20 which is formed at the rear of the concave surface portion 18. A lower portion of the opening 14 is formed by an erect wall 21 which makes up a lower portion of the front wall 17.

Figure 11:
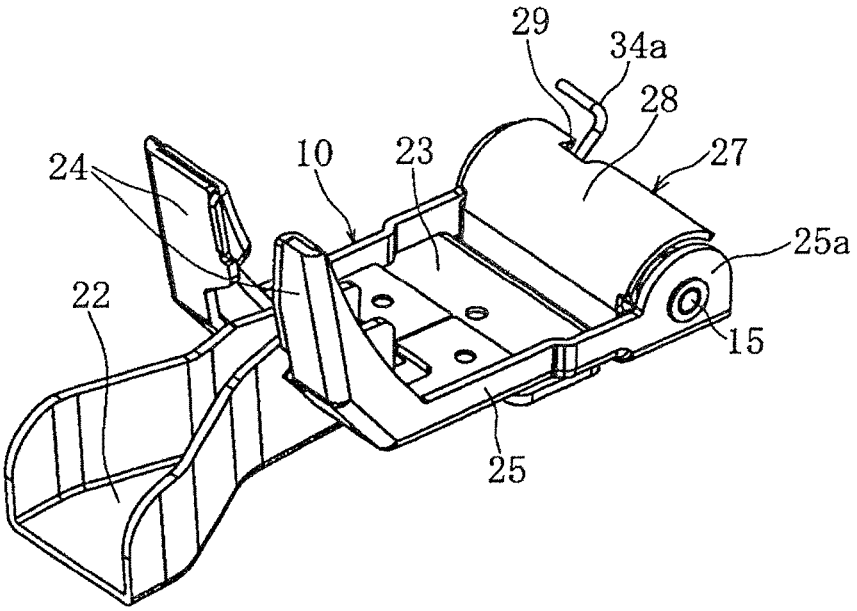
FIG. 11 is a perspective view of the movable curl guide.
Figure 12:
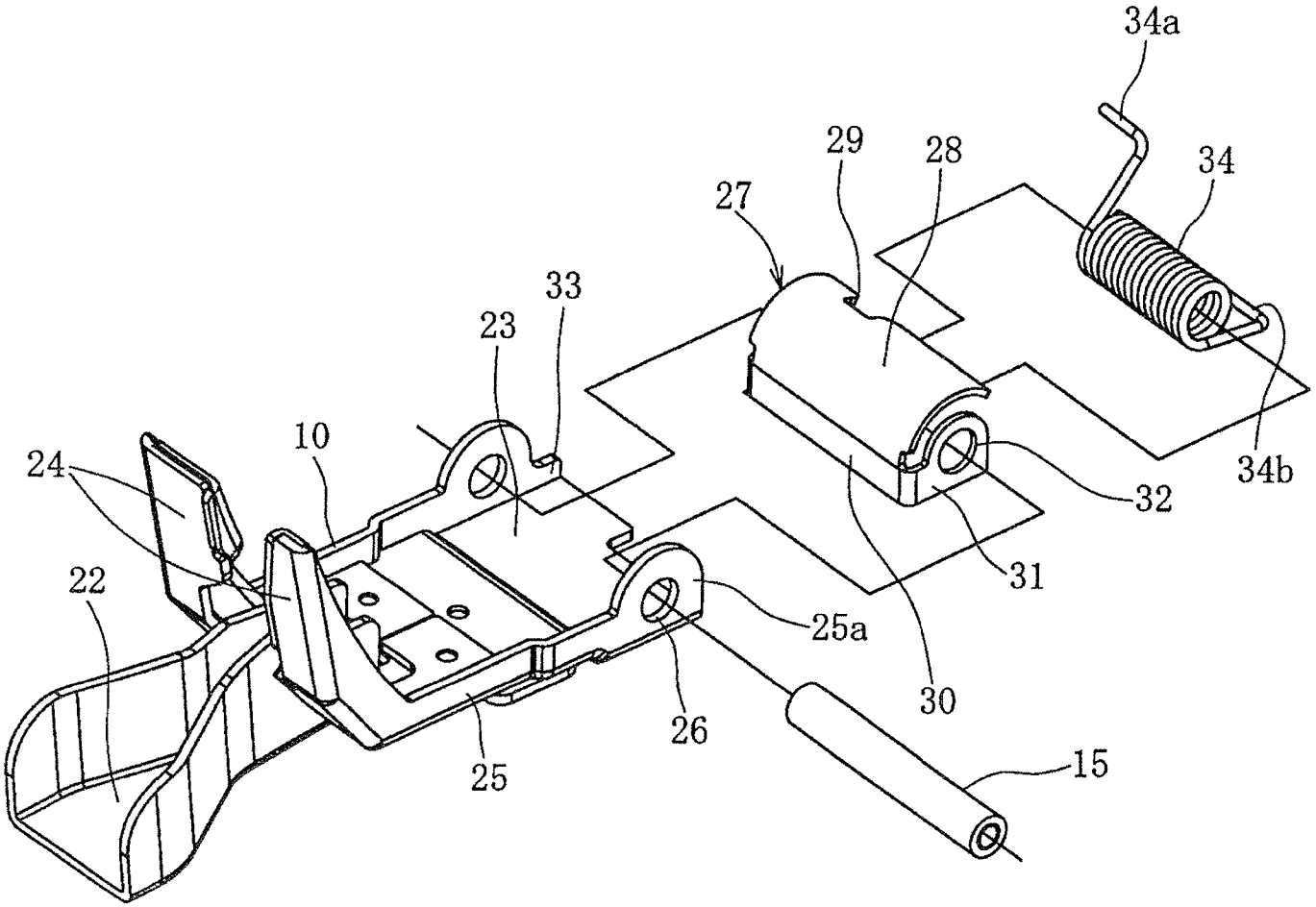
FIG. 12 is an exploded perspective view of the movable curl guide.

As is shown in FIGS. 11 and 12, a guide groove 22 is formed at a front portion of the movable curl guide 10 so as to be widened in width at a front end thereof, and a plate-like portion 23 is formed at a rear portion thereof. Guide members 24 are formed to be erected on the plate-like portion 23, and these guide members 24 are situated on both sides of a base portion of the guide groove 22 to guide the wire 4 so as not to wobble. Erected edges 25 are formed on both sides of the plate-like portion 23. Distal ends of the erected edges 25 are made integral with the guide members 24. Base portions 25*a* of the erected edges 25 are formed into an arc-like shape. Bearing holes 26 are formed in central portions of the base portions 25*a*.

An abutment piece 33 is formed at the rear of one of the erected edges 25 so as to extend therefrom.

A cover portion 27 is disposed at an upper portion of a base portion of the movable curl guide 10. This cover portion 27 is made up of a cover main body 28 having an arc-like shape in section, a lower wall piece 30 which is formed to be suspended from a lower portion of a front end of the cover main body 28 and side pieces 31 which are bent to the rear from both side edges of the lower wall piece 30. A spring receiving groove 29 is formed at a rear end of the cover main body 28, and bearing holes 32 are formed in the side pieces 31. A central portion of the arc of the cover main body 28 is formed to be centers of the bearing holes 32.

The cover portion 27 is disposed on the plate-like portion 23 of the movable curl guide 10 together with a torsion coil spring 34 and is connected thereto by a pivot 15 which is inserted into both the bearing holes 26, 32. The side piece 31 and the abutment piece 33 are brought into abutment with each other on the plate-like portion 23. Consequently, as is shown in FIGS. 9(*a*) and 9(*b*), the cover portion 27 rotates together with the movable curl guide 10 at all times.

Incidentally, the pivot 15 is supported rotatably by bearing portions (not shown) which are provided on both sides of an interior of the opening 14 of the binding machine main body, and one end 34*a* of the torsion coil spring 34 projects from the spring receiving groove 29 in the cover portion 27 so as to be brought into engagement with the recess portion 20 on the upper surface portion 16 of the opening 14. The other end 34*b* is brought into engagement with an upper surface of the plate-like portion 23. Although a distal end side of the movable curl guide 10 is biased so as to rotate upwards by the configuration described above, for example, since an end face or a rear portion of the plate-like portion 23 is brought into abutment with the lower portion of the opening 14, the movable curl guide 10 is stopped to stand still in that position, and the movable curl guide 10 can be rotated downwards against the spring force of the torsion coil spring 34.

According to the configuration described above, the cover portion 27 closes a gap between the base portion of the movable curl guide 10 and the upper surface portion 16 of the opening 14 at all times. Then, when the movable curl guide 10 is rotated downwards for some reason, the cover portion 27 is also rotated at the same time as is shown in FIG. 9(*b*). Since the cover main body 28 is formed into the arc-like shape in section, the gap between the upper surface 16 and the opening 14 is kept closed. (As this occurs, the cover main body 28 and the upper surface portion 16 may be dimensioned so as to be brought into sliding contact with each other.) Consequently, since the gap is kept closed at all times from before to after the rotation of the movable curl guide 10, a foreign matter 35 such as a small piece of wire which happens to fall on the movable curl guide 10 can be prevented from entering an interior of the binding machine main body in an ensured fashion.

Figure 13A:
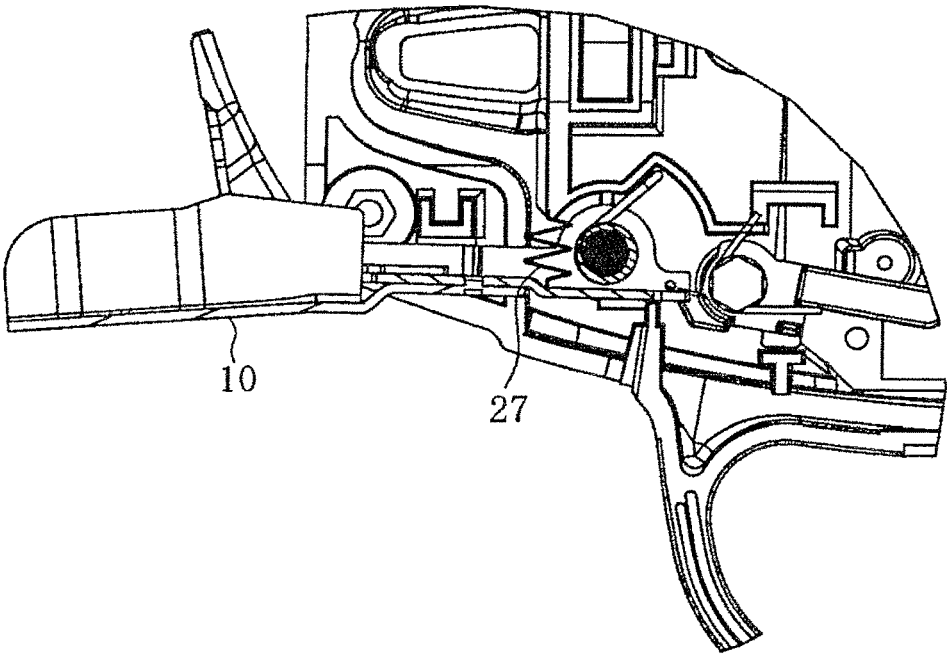
FIGS. 13(*a*) and 13(*b*) show a waiting state and an operating state of a cover portion of another embodiment.
Figure 13B:
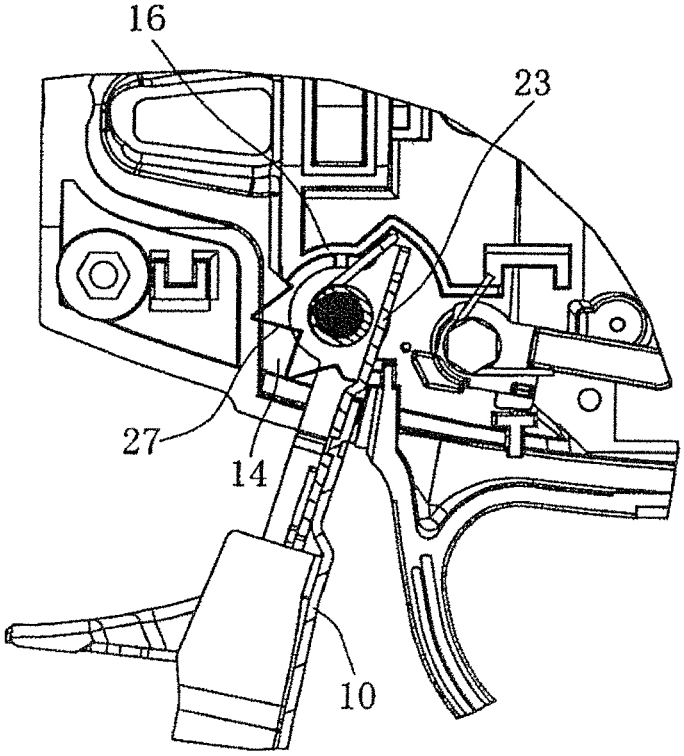

The cover portion 27 only has to be configured to close the gap at all times from before to after the rotation of the movable curl guide 10. Consequently, the invention is not limited to the form that has been described above. For example, as is shown in FIGS. 13(*a*) and 13(*b*), a cover portion 27 may be configured to have a bellows-like shape.

In this case, too, when the movable curl guide 10 is rotated downwards, the cover portion 27 extends. Consequently, even in the event that as the movable curl guide 10 rotates, the gap between the plate-like portion 23 at the base portion of the movable curl guide 10 and the upper surface portion 16 of the opening 14 is increased or decreased, the gap can be closed at all times accordingly.

Figure 14:
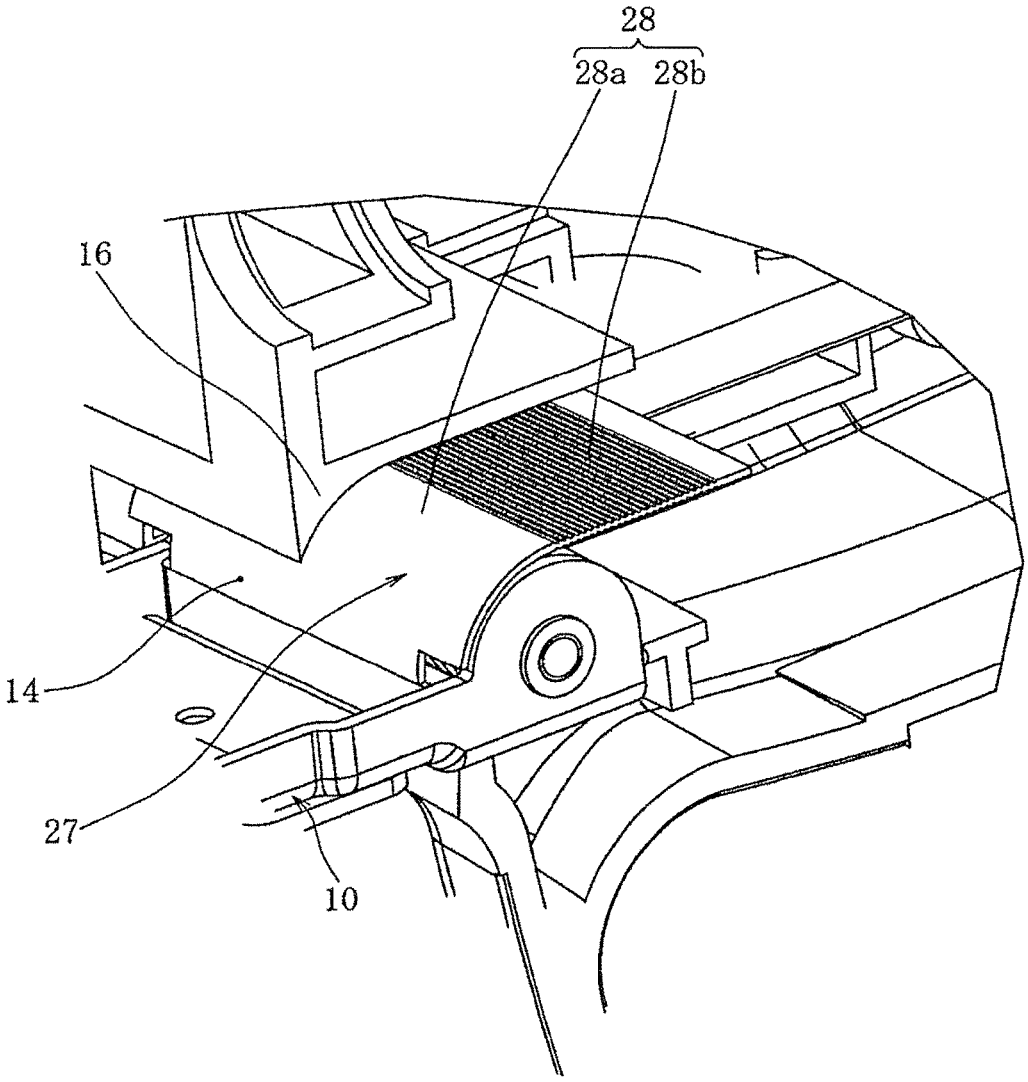
FIG. 14 shows a waiting state of a cover portion of a further embodiment.
Figure 15:
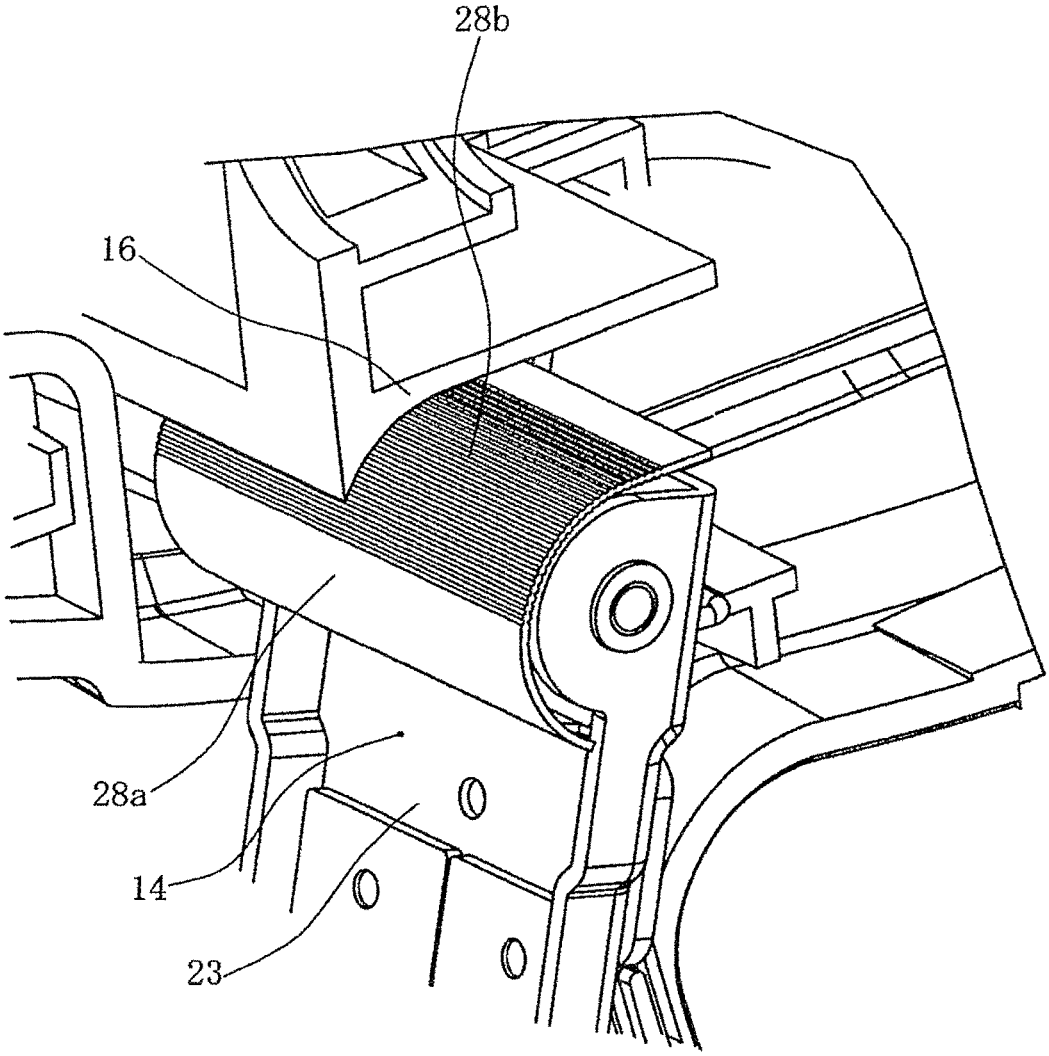
FIG. 15 shows an operating state of the cover portion of FIG. 14.

As is shown in FIGS. 14, 15, a cover main body 28 of a cover portion 27 may be made of an elastic material, and the cover main body 28 may be configured so that a front half portion is formed as a curved portion 28*a* having an arc-like shape in section and a rear half portion is formed as a wavy portion 28*b* having flexibility. In this case, too, even in the event that as the movable curl guide 10 rotates, the gap between the plate-like portion 23 at the base portion of the movable curl guide 10 and the upper surface portion 16 of the opening 14 is increased or decreased, the gap can be closed at all times accordingly.

Further, the cover portion does not have to be formed as the separate element from the movable curl guide as described in the embodiments. If possible, both the members may be formed integral with each other. Alternatively, both the members are formed separate from each other and may then be made integral with each other by welding or the like.

DESCRIPTION OF REFERENCE NUMERALS

2 binding machine main body; 5 fixed curl guide; 10 movable curl guide; 33 abutment piece; 14 opening; 15 pivot; 16 upper surface portion; 27 cover portion; 105 wire; 106 guide portion; 114 cutting die; 115 cutter main body; 115*a* blade portion; 117 wire through hole; 130 engagement portion.

What is claimed is:

1. A reinforcing bar binding machine comprising:

a binding machine main body;

a guide tube that guides a wire fed from a wire reel in a distal end direction of the binding machine body, the wire reel being mounted on the binding machine body;

a guide portion that is provided in a distal end side of the binding machine body and that curls and feeds the wire from the guide tube;

a curling-tendency applying mechanism that is provided in the guide portion, that curls the wire and that applies a curling tendency on the wire to feed the wire;

wherein the curling-tendency applying mechanism comprises:

a curl guide that guides the wire from the guide tube in a curl direction;

a first guide member that guides an external surface which is an outer side of the wire to be bent such that the external surface slides on a surface of the first guide member, the first guide member being fixed to the binding machine main body such that the surface of the first guide member is stationary with respect to the binding machine main body;

a second guide member that guides an internal surface which is an inner side of the wire to be bent such that the internal surface slides on a surface the second guide member, the second guide member being fixed to the binding machine main body such that the surface of the second guide member is stationary with respect to the binding machine main body; and a third guide member that guides the external surface, a wire cutting mechanism that is disposed between the guide tube and the curl guide and that is capable of cutting the wire from the guide tube;

the first guide member is disposed at the guide tube or disposed between the guide tube and the wire cutting mechanism;

the second guide member is disposed at the guide tube or disposed between the guide tube and the wire cutting mechanism; and the third guide member is disposed at the curl guide;

wherein the second guide member is disposed between the first guide member and the cutting mechanism, in the guide portion, an end portion of the guide tube, the wire cutting mechanism and the curl guide are disposed in that order, and the first guide member, the second guide member and the third guide member are brought into contact with the wire fed from the wire reel to apply a curling tendency.

2. The reinforcing bar binding machine according to claim 1, wherein the curl guide includes a guide surface to guide the wire; and wherein the third guide member projects from the guide surface.

* * * * *